United States Patent [19]

Brunett

[11] Patent Number: 4,708,509

[45] Date of Patent: Nov. 24, 1987

[54] APPARATUS FOR SUPPORTING AND STORING ENGINEERING DRAWINGS AND THE LIKE

[76] Inventor: Juanita L. Brunett, 41183 Southward, Canton Township, Wayne County, Mich. 48188

[21] Appl. No.: 897,480

[22] Filed: Aug. 18, 1986

[51] Int. Cl.[4] ..... B42F 3/00; B42F 15/06; B42F 13/40; A47B 63/06

[52] U.S. Cl. ..... 402/4; 402/80 R; 312/183; 312/184

[58] Field of Search ..... 402/1, 3, 4, 40, 43, 402/80 P, 80 R, 56, 60; 312/183, 184, 185

[56] References Cited

U.S. PATENT DOCUMENTS

| | | | |
|---|---|---|---|
| 1,964,252 | 6/1934 | Dawson | 402/80 R |
| 2,495,687 | 1/1950 | Belmont | 402/4 |
| 2,664,302 | 12/1953 | Griffin | 402/4 |
| 3,190,293 | 6/1965 | Schneider et al. | 402/4 |
| 3,540,832 | 11/1970 | Morris | 402/80 R |
| 4,603,995 | 8/1986 | Vilona | 402/80 R |

*Primary Examiner*—E. R. Kazenske
*Assistant Examiner*—Paul M. Heyrana, Sr.
*Attorney, Agent, or Firm*—Harness, Dickey & Pierce

[57] ABSTRACT

Apparatus for supporting and storing engineering drawings and similar large size paper sheets comprising a plurality of longitudinally aligned ring binder assemblies each of which includes a plurality of rings which can be opened and closed and extended through holes formed in the paper sheets to be supported, an elongated support member connected to and arranged in a supporting relation with the binder assemblies and provision for disposing the support member in a horizontal position with the ring binder assemblies extending downwardly therefrom so that the paper sheets hung on the rings can hang downwardly from the rings. In one form of the invention, the elongated support member consists of a clamp assembly of a type presently used for supporting engineering drawings and the like and in another embodiment of the invention, the elongated support member is secured directly to the binder assemblies and is supported from a suspension hook.

1 Claim, 9 Drawing Figures

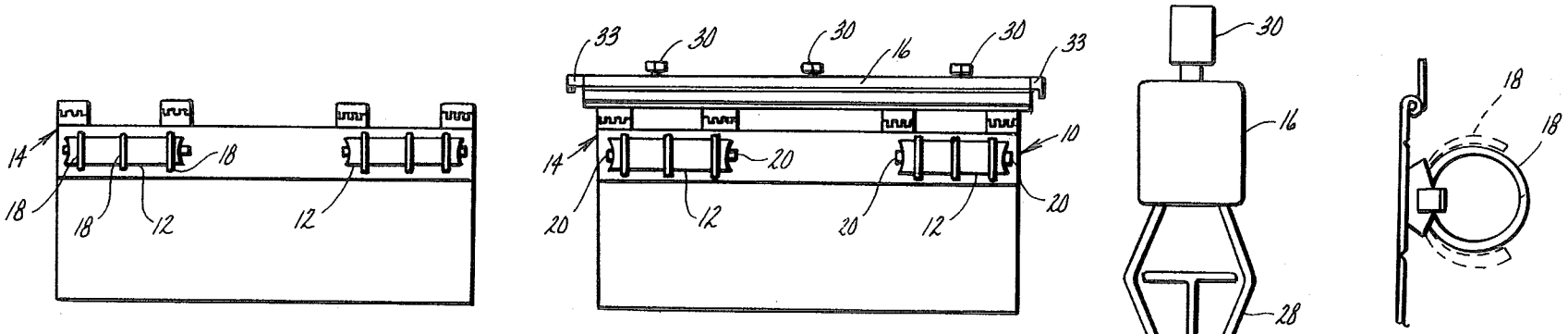
Fig. 1
Fig. 2
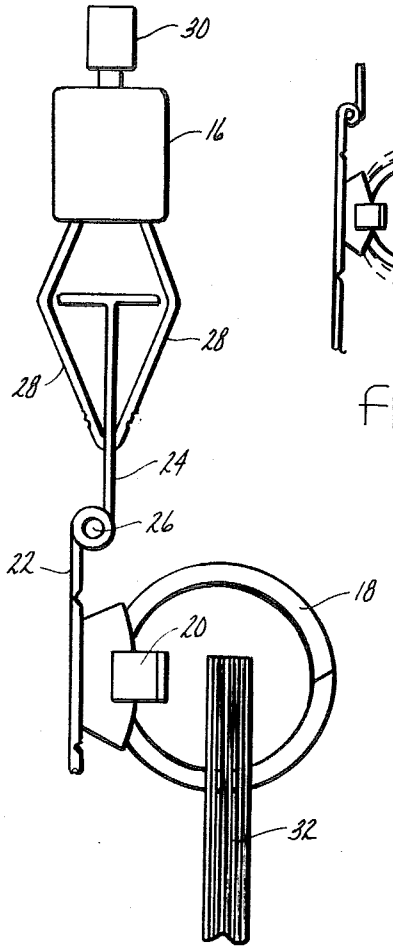
Fig. 4
Fig. 5
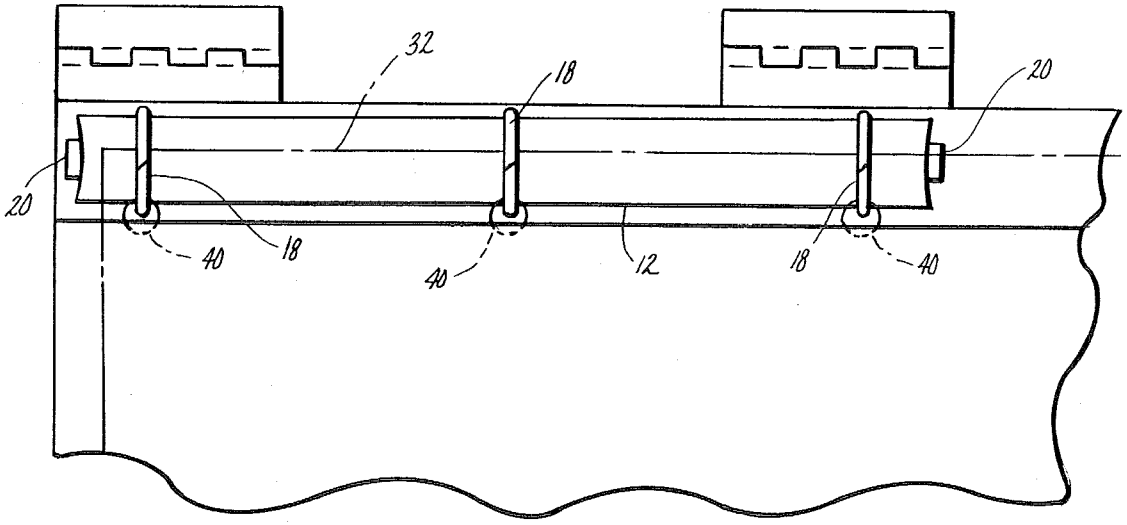
Fig. 3

APPARATUS FOR SUPPORTING AND STORING ENGINEERING DRAWINGS AND THE LIKE

BACKGROUND OF THE INVENTION

This invention relates generally to apparatus for supporting and storing large size paper sheets such as engineering drawings and the like which are customarily stored either in large flat drawers or suspended from large clamp-like assemblies which keep the drawings in groups or stacks.

In both cases, it is difficult to review the drawings one by one or remove drawings singly from the groups or add drawings singly to the groups. Accordingly, it is an object of this invention to provide improved apparatus for supporting and storing engineering drawings and the like which facilitates one by one review of the drawings and the removal of the drawings singly and the addition of drawings singly.

SUMMARY OF THE INVENTION

The apparatus of this invention consists of a plurality of longitudinally aligned ring binder assemblies each of which includes a plurality of rings which can be opened and closed and extended through holes formed in the paper sheets to be supported. The ring binder assemblies are thus of the general type in common use in three ring binder notebooks and in the preferred embodiment of the invention two such binder assemblies are utilized.

An elongated support member is connected to and arranged in a supporting relation with the binder assemblies so that the binder assemblies are longitudinally aligned, by which is meant the rings thereon are in substantial axial alignment. The support member also includes means which enables disposition of the support member in a horizontal position with the ring binder assemblies therebelow and extending downwardly therefrom so that drawings can hang downwardly from the rings.

In one form of the invention, the elongated support member is a conventional bar type support which includes selectively operable clamping fingers. A separate hinge assembly is secured to the ring binder assemblies and is clamped between the clamping members on the support member. This enables the ring binder assemblies to be pivoted relative to the support member about an axis parallel to the length of the support member to facilitate handling of the drawings and examination of the drawings in either their suspended positions or positions supported on a flat table. It also enables continued use of the bar type supports which include clamps and large numbers of which are in present use.

In a second embodiment of the invention, the support member is secured directly to the ring binder assemblies which are arranged in a spaced relation longitudinally of the support member and the support member is provided with a moveable hook which enables it to be hung on a support like a coat hanger.

The apparatus of this invention thus provides support and storage facilities for engineering drawings and the like which enables convenient examination of the drawings, a large capacity for drawing storage, and easy handling of the drawings. A drawing can be removed from a supported position by simply locating the drawing, opening the ring members and removing the drawing therefrom. Conversely, a drawing can be added to a group supported on a support member by simply opening the ring members, extending the ring members through conventional holes in the drawings and then closing the ring members.

Further objects, features and advantages of the invention will become apparent from a consideration of the following description and the appended claims when taken in connection with the accompanying drawing in which;

FIG. 1 is a plan view of a ring binder and hinge assembly in the apparatus of this invention;

FIG. 2 is a plan view like FIG. 1 showing the hinge assemblies mounted support member which includes clamp apparatus engage with the hinge assembly;

FIG. 3 is an enlarged fragmentary view of a portion of the assembly shown in FIG. 1;

FIG. 4 is a sideview of the structure shown in FIG. 3;

FIG. 5 is an enlarged sideview of the structure shown in FIG. 2 and showing a plurality of drawings supported on the ring binder assemblies;

Figure 6:
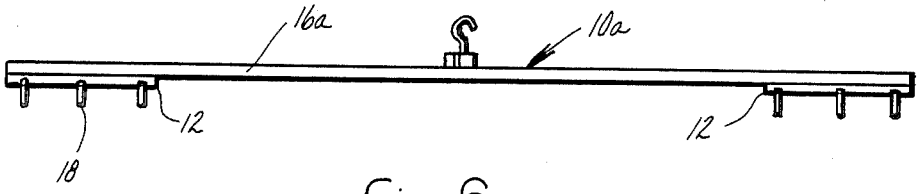
FIG. 6 is an elevational view of a modified form of the apparatus of this invention.

With reference to the drawing, the apparatus of this invention, indicated generally at 10, is illustrated in FIG. 2 as including a plurality of ring binder assemblies 12 mounted on a hinge assembly 14 which is in turn secured to an elongated support member 16. As shown in FIG. 2, the ring binder assemblies 12 are longitudinally aligned in a direction lengthwise of the support member 16, each of the ring binders 12 in the illustrated embodiment of the invention being a conventional three ring binder assembly commonly used in notebooks. Each of the ring binder assemblies 12 includes three rings 18 moveable between the closed position shown in solid lines in FIG. 4 and the open position shown in broken lines in FIG. 4. Actuator members 20 at the ends of the assembly are operable to move the rings 18 between their open and closed positions in a conventional manner.

As shown in FIG. 2, the binder assemblies 12 are arranged so that the rings 18 are substantially in axial alignment along an axis parallel to the length of the support bar 16. The hinge assembly 14 includes hinge members 22 and 24 which are hingedly connected for relative pivotal movement about a pin 26. The hinge members 24 extend upwardly and are supported on the support bar 16.

The support bar 16 includes a pair of clamping plates 28 extending downwardly therefrom and forming a part of the structure of the support bar 16. Actuator members 30 are threaded onto the bar 16 and are operable to move the clamping members 28 toward and away from each other and when moved toward each other to the clamping position shown in FIG. 5, they clamp the support bar 16 to the hinge assembly 14.

In the use of the apparatus 10, the rings 18 are opened and a plurality of drawings or other large size sheets of paper comprising a stack of papers are supported on the rings 18. The rings 18 are then closed. The drawings 32 can then be suspended from the rings 18 so that they hang downwardly therefrom and the bar 16 can be disposed in a horizontal supported position for storage purposes. End extensions 33 on the bar 16 enable the bar 16 to be supported at its ends on horizontal supports with the sheets 32 suspended therebetween. Also, the drawings 32 can be laid on a flat table along with the binder assemblies 12, the hinge assembly 14 and the support bar 16. The ability of the rings 18 to be moved relative to the support bar 16 about the pin 26 facilitates the handling of the stack of sheets 32 and the sheets 32 can be manipulated and handled easily in horizontal positions. Also, single ones of the sheets 32 can be readily removed by manipulation of the rings 18 and additional sheets 32 can be added singly by manipulation of the rings 18.

Figure 7:
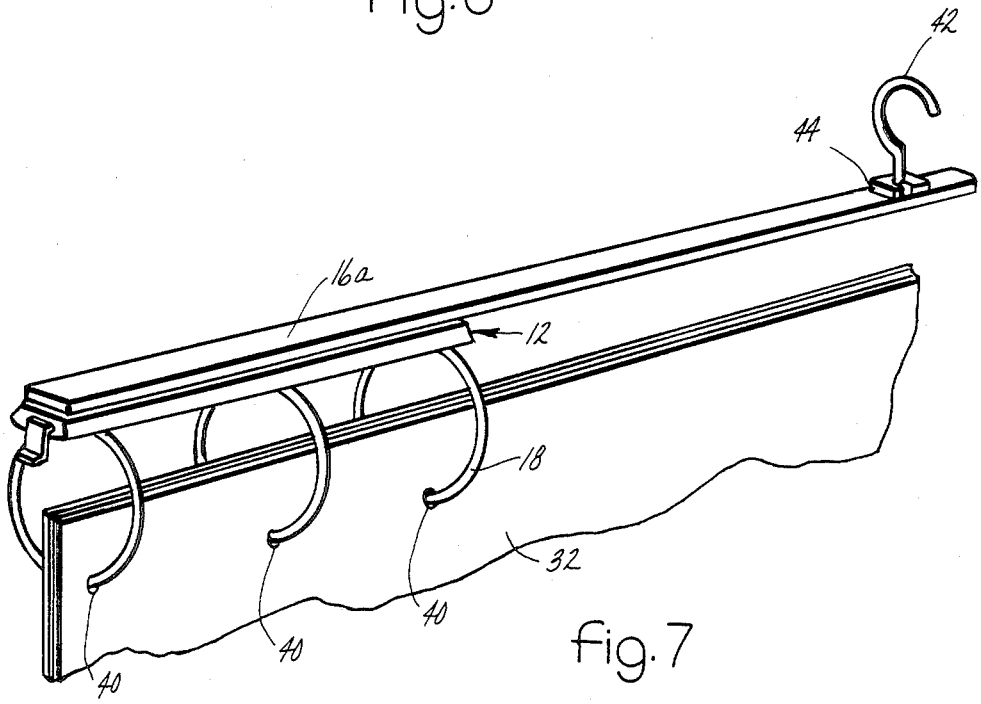
FIG. 7 is an enlarged fragmentary perspective view of a portion of the apparatus illustrated in FIG. 6.

A modified form of the apparatus of this invention, indicated generally at 10*a*, is illustrated in FIGS. 6–9, inclusive. The apparatus 10*a* includes ring binder assemblies 12 identical to those previously described arranged in longitudinal alignment and supported directly on an elongated support bar 10*a*. Each of the ring binder assemblies 12 includes a plurality of rings 18 for supporting a large stack of large size paper sheets 32, as shown in FIG. 7, by forming holes 40 in the sheets 32 and threading the sheets onto the rings 18 by extending the rings 18 through the holes 40.

The support bar 16*a* can thus either be disposed in a horizontal position with the ring binder assemblies 12 therebelow and extending downwardly therefrom so that the paper sheets 32 can hang downwardly from the rings 18, as shown in FIG. 7, or the sheets 32 can be laid flat on a table with the bar 16*a* along side the stacked sheets 32. To facilitate hanging of the bar 16*a*, a suspension hook 42 is moveably mounted on a mounting block 44 secured to the topside of the bar 16*a* as shown in FIGS. 6 and 7.

Figure 9:
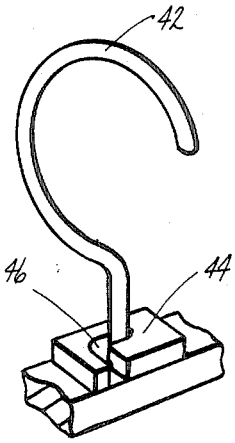
FIGS. 8 and 9 are fragmentary perspective views of the support hook in the modified apparatus shown in FIG. 6 showing the hook in inoperative and operative positions, respectively.
Figure 8:
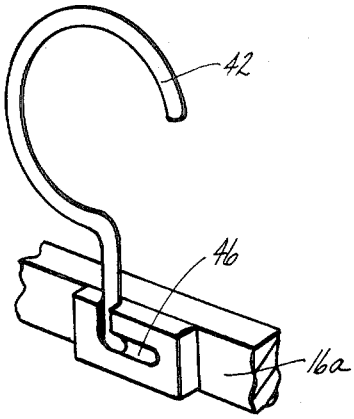

The block 44 is provided with an undercut groove 46 which enables the hook 42 to be moved between its operative position shown in FIGS. 7 and 9 in which the support bar 16*a* is suspended from the hook 42 and an inoperative position shown in FIG. 8 in which the hook 18 is disposed in a plane alongside the plane of the bar 16*a*. This enables the hook 42 to be moved out of the way when it is not being used to suspend the bar 16*a*.

From the above description it is seen that this invention provides two embodiments of the invention, 10 and 10*a*, and that in both embodiments the apparatus enables improved storing and handling of large size paper sheets such as engineering drawings. This improvement enables easier handling of the drawings and the single addition and removal of drawings when desired.

What is claimed is:

1. Apparatus for supporting and storing large size paper sheets comprising a plurality of longitudinally aligned ring binder assemblies each of which includes a plurality of ring members which can be opened and closed and extended through holes formed in paper sheets to be supported, an elongated support member for said ring binder assemblies, at least one hinge assembly connected to and extending between said ring binder assemblies and said support member to enable pivotal movement of said ring members relative to said support member including means enabling disposition of said support member in a horizontal position with said ring binder assemblies therebelow and extending downwardly therefrom with said ring members extending generally horizontally to one side of said hinge assembly so that paper sheets can hang downwardly from said ring members, said apparatus being movable to a position in which said ring members extend upwardly to one side of said support member to facilitate laying of paper sheets on said ring members on a horizontal table surface.

* * * * *